United States Patent [19]

Compton et al.

[11] 4,093,418

[45] June 6, 1978

[54] METHOD OF SPOTTING GARMENTS TO BE LAUNDERED

[75] Inventors: John William Compton, Taylor; Stephen Ellis Eisenstein, Southfield, both of Mich.

[73] Assignee: BASF Wyandotte Corporation, Wyandotte, Mich.

[21] Appl. No.: 780,557

[22] Filed: Mar. 23, 1977

[51] Int. Cl.[2] ..... D06L 1/00

[52] U.S. Cl. ..... 8/142; 252/170

[58] Field of Search ..... 8/137; 252/170, 171

[56] References Cited

U.S. PATENT DOCUMENTS

| | | | |
|---|---|---|---|
| 3,382,285 | 5/1968 | Eagon et al. | 8/137 |
| 3,625,909 | 12/1971 | Berg et al. | 252/171 |
| 3,741,902 | 6/1973 | Barrett | 8/142 |
| 3,764,544 | 10/1973 | Haworth | 252/170 |
| 3,772,205 | 11/1973 | Dongas | 252/171 |
| 3,872,021 | 3/1975 | McKnight | 252/170 |

OTHER PUBLICATIONS

Isopar M, Exxon, pp. 1-2.

*Primary Examiner*—William E. Schulz
*Attorney, Agent, or Firm*—John W. Linkhauer; Bernhard R. Swick; Robert E. Dunn

[57] ABSTRACT

The invention provides a method of use for a spotting-agent composition for use in laundering garments is provided which consists essentially of a solution of (1) about 10 weight percent or more of a nonionic surfactant produced by reacting a mixture of fatty alcohols containing 10 to 18 carbon atoms (with the proviso that the proportion of such alcohols which is attributable to alcohols containing 17 or more carbon atoms is limited to about 20 percent by weight) with mixed lower-alkylene oxides (ethylene oxide and propylene oxide) to such an extent as to have the mixed oxides comprise about 57 to 68 weight percent of the total fatty alcohol plus alkylene oxides used, with the proportion of ethylene oxide in the mixed oxides used being about 50 to 70%, in (2) an isoparaffinic solvent made of a mixture of isoparaffins containing about 11 to 14 carbon atoms.

4 Claims, No Drawings

METHOD OF SPOTTING GARMENTS TO BE LAUNDERED

BACKGROUND OF THE INVENTION

1. Field of the Invention:

This invention relates to compositions of matter useful in the laundering of garments as spotting agents, i.e., materials supplied to an area which is especially soiled, before the laundering operation, to bring about or to improve the removal of soil from an area which is in need of special attention. As such, the invention is particularly concerned with compositions in the nature of a solution of a nonionic surfactant in an organic solvent. The invention concerns, in one aspect, novel compositions of matter, and in another aspect, the invention concerns a method of laundering a garment which amounts to the use of such compositions in the manner indicated above.

2. Description of the Prior Art:

The closest prior art of which the inventors are aware is the use, for the purpose indicated above, of a composition consisting of about 10 weight percent of a nonionic surfactant made by adding 5 moles of ethylene oxide to a mixture of fatty alcohols containing 11 to 15 carbon atoms, dissolved in a solvent which is a mixture of isoparaffins containing about 11 to 14 carbon atoms having an average molecular weight of about 191. Such a solvent is commercially available in the United States from the Humble Oil Division of Exxon Corporation, being sold under the designation "ISOPAR M". Such isoparraffinic solvent is desirable because of its low odor, its high flash point of approximately 175° F, its relatively low volatility, as evidenced by a boiling point of about 400° F, its low level of impurities, and its low level of toxicity.

It can be admitted that many nonionic surfactant compositions are known which are made from fatty alcohols containing 10 to 18 carbon atoms plus ethylene oxide and/or propylene oxide, used in various proportions. Materials of this general kind are disclosed, for example, in U.S. Pat. No. 3,504,041; U.S. Pat. No. 3,382,285; and U.S. Pat. No. 2,575,298. It is known, moreover, that a number of such alkoxylated fatty alcohols are soluble to an extent of 10% or more in many organic solvents, such as benzene, xylene, acetone, carbon tetrachloride, perchlorethylene, methyl alcohol, ethyl alcohol, chloroform, methyl ethyl ketone, and butyl CELLOSOLVE. All of the above-mentioned organic solvents, with the exception of the isoparaffinic solvent, present problems in respect to flammability, toxicity, or capability of dissolving certain kinds of man-made fabric. Relatively little is known concerning the extent to which such nonionic surfactants are soluble in the above-mentioned isoparaffinic solvent.

SUMMARY OF THE INVENTION

A spotting-agent composition for use in laundering garments is provided which consists essentially of a solution of (1) about 10 weight percent or more of a nonionic surfactant produced by reacting a mixture of fatty alcohols containing 10 to 18 carbon atoms (with the proviso that the proportion of such alcohols which is attributable to alcohols containing 17 or more carbon atoms is limited to about 20 percent by weight) with mixed lower-alkylene oxides (ethylene oxide and propylene oxide) to such an extent as to have the mixed oxides comprise about 57 to 68 weight percent of the total fatty alcohol plus alkylene oxides used, with the proportion of ethylene oxide in the mixed oxides used being about 50 to 70%, in (2) an isoparaffinic solvent made of a mixture of isoparaffins containing about 12 to 13 carbon atoms.

DESCRIPTION OF THE PREFERRED EMBODIMENTS

In accordance with the present invention in its broadest aspect, there is provided a composition of matter which consists essentially of a nonionic surfactant, as described above, and an isoparaffinic solvent, also as described above. It is considered essential, moreover, that these components or ingredients be compatible with each other to such an extent that, at room temperature, it is possible to form a solution of the surfactant in the solvent and, in addition, it is possible to subject such a composition to a low temperature, such as 0° C, for several hours, without causing the composition to separate into distinct phases.

It is desirable, moreover, to provide a composition of matter which yields results which are superior, in respect to the performance in washing tests, to the results which are obtained with the use of the composition mentioned above as constituting the closest prior art known to the inventors, namely, 10% of nonionic surfactant of the kind indicated above in the above-designated organic solvent.

To be candid, the inventors have been concerned principally with the development of a nonionic surfactant which has properties suiting itself to the intended end use. The inventors have been content to believe that, in the present state of the art, the use of an isoparaffinic solvent of the kind indicated above would be necessary.

The invention does not concern the use, with such isoparaffinic solvent, of, for example, a fatty alcohol fraction based upon alcohols containing 16 to 18 carbon atoms, reacted with a 60/40 mixture of ethylene/propylene oxides under conditions such that the mixed lower alkylene oxides in the charge amounting to 60 weight percent thereof, because when that was tried, the solubility in the isoparaffinic solvent was distinctly poor.

The invention does not concern the use, as the nonionic surfactant, of a material which is based upon 22% of $C_{12}$ to $C_{15}$ fatty alcohol, oxyalkylated first with a mixture of propylene oxide and ethylene oxide in a weight ratio of 2:1 to an average molecular weight of approximately 350, and then further oxyalkylated with a mixture of ethylene oxide and propylene oxide, 2 parts ethylene oxide to 1 part propylene oxide by weight, to an average molecular weight of about 965. Such a material was also tried, and was also found poor in respect to its solubility in the isoparaffinic solvent.

Coming even closer, the present invention does not concern the use of a nonionic surfactant based upon "Blend A", where "Blend A" is a mixture of fatty alcohols which may be characterized as approximately 10% $C_{12}$, 15% $C_{13}$, 35% $C_{14}$, 10% $C_{15}$, 20% $C_{16}$, and 10% $C_{18}$-but only whenever either the degree of alkoxylation (i.e., the percentage by weight of mixed alkylene oxides used in the charge to the autoclave in which the nonionic surfactant is formed) is unsuitable, being under about 57 or over about 68 percent by weight, or whenever the proportion of ethylene oxide used in the charge of mixed alkylene oxides is not at a suitable value, namely, between 50 and about 70 percent by weight of the total of the mixed alkylene oxides. A material such as "Blend A" is capable of being used, along with a suitable proportion of mixed oxides, such as about 64 weight percent of the total charge of alkylene oxides plus fatty alcohol, and especially when the weight percentage of the ethylene oxide in the total charge of alkylene oxides is at approximately 60 percent by weight, to produce a spotting agent having admirable properties, including low flammability, relatively superior solubility in the isoparaffinic solvent, detergency superior to that of the composition mentioned above as constituting the closest prior art, and in at least some instances, adequate toxicity properties.

Toxicity is a problem, although usually a relatively minor one, in respect to compositions of this sort; the problem, when it exists, is not concerned with the garments in their condition as finally laundered, so much as it may be concerned with the measures that need to be taken in order to protect the health of persons using the spotting agent of the present invention in the pre-laundering agent-application step. In the field of nonionic surfactants, it is known, in general, that toxicity is less likely to be a problem if the material involved is of greater molecular weight. Accordingly, it has been somewhat surprising to the applicants that with one of their preferred compositions, namely, "Blend A" plus a mixture of lower alkylene oxides containing 60 percent by weight of ethylene oxide, to the extent of 64 percent by weight of mixed lower alkylene oxides in the charge, produced, when mixed with a proper quantity of isoparaffinic solvent, a composition concerning which a question was raised about the toxicity of the material involved, especially considering that the best other composition known, prior to the present invention, was one that should be, if anything, more toxic, considering that its surfactant is of lower average molecular weight.

The consideration that the composition according to the invention should contain at least about 10 weight percent or more of nonionic surfactant is based upon the desirability of having available, during the subsequent laundering operation, an adequate proportion of surface-active agent. Doubtless, other compositions can be made which are relatively poorer in their content of surface-active agent, but these can be expected to be correspondingly lower in effectiveness with respect to removing spots of organic soil. In the other direction, namely, the direction of using a greater percentage of nonionic surfactant, the principal limitation is the solubility of the nonionic surfactant in the isoparaffinic solvent. The solvent is lower in cost, per unit of weight or volume, than the surfactant; accordingly, it is advantageous to extend the activity of the nonionic surfactant by the use of such isoparaffinic solvent, which itself has a substantial solvent effect upon most of the instances of organic soil which are treated in accordance with the present invention. From the research which has been conducted to date, however, it appears that it would be unusual to find a nonionic surfactant of this kind which is soluble in the kind of isoparaffinic solvent indicated above to an extent of greater than about 15 or 20 percent by weight. In making these materials, instances have been found in which there were prepared nonionic surfactants for this use which were, for example, only marginally soluble in the isoparaffinic solvent at the 10% level, or even noticeably insoluble at the 5% level.

The general manner of making a suitable nonionic surfactant for use in accordance with the present invention is a matter familiar to those of ordinary skill in this art. In general outline, the fatty alcohols are charged to an autoclave and heated and stirred to obtain a homogeneous mixture. Ordinarily, a suitable basic catalyst such as potassium hydroxide, in some amount such as 0.005% to 1 percent by weight of the total reaction mixture, it is also added, usually before such stirring. Usually, the autoclave is evacuated to an absolute pressure such as approximately 10 torr or less, with the temperature of the material in the autoclave at approximately 125° C, to remove any water present and thus ensure the purity of the fatty alcohols charged. Then the vacuum is relieved by the admission of pure nitrogen, and thereafter, mixed oxides, ethylene oxide and propylene oxide, are added at a suitable rate, maintaining the pressure within the autoclave at under 7 to 10 atmospheres, and the contents of the autoclave are reacted to a substantially constant pressure, such as a change of less than 0.4 atmosphere per hour. The contents of the autoclave are cooled to approximately 50 to 60° C, discharged, and then worked up in the ordinary manner, using, for example, finely divided magnesium silicate as an adsorbent and diatomaceous earth as a filter aid, and then finally subjecting the material to vacuum treatment at a suitable temperature such as 110° C to remove any water or other volatile impurity along with the adsorbent and/or filter aid.

The mixing of a nonionic surfactant satisfying the requirements of the present invention, in accordance with the teachings given above, into a suitable isoparaffinic solvent, and the use of the composition so obtained as a spotting agent in the laundering of garments should not, in view of what has been said above, present any challenge to a person or ordinary skill in the art.

The invention described above is further illustrated by the following specific examples, which are to be interpreted as being illustrative, and not in a limiting sense.

EXAMPLE 1

There was prepared a nonionic surfactant by the reaction of "Blend A", as mentioned above, with a mixture of 60% of ethylene oxide and 40% of propylene oxide, said percentages being by weight, the mixed oxides amounting to 57.6 percent by weight of the charge of mixed oxides plus fatty alcohols. There was produced a nonionic surfactant having a hydroxyl number of 100.2, a Draves sink time of 34.9 seconds, a surface tension of 32.4 dynes per centimeter, and a cloud point of28.5° C in an aqueous solution containing 1 percent by weight of such nonionic surfactant. The material had an HLB value of 5.5.

Such material was mixed, at the rate of 10 percent by weight of said nonionic surfactant, with isoparaffinic solvent as indicated above, and the material was then used as a spotting agent in the laundering of garments. Satisfactory results were obtained. Indeed, the results were superior in detergency, when compared with similar results obtained with the composition mentioned above as constituting the closest prior art.

"Blend A" may be made conveniently by mixing two commercially available fatty-alcohol materials, namely, a first one which is generally known to contain $C_{12}$ to $C_{15}$ fatty alcohols and a second one which is generally known to contain $C_{14}$ to $C_{18}$ fatty alcohols, in equal proportions by weight.

EXAMPLE 2

Example 1 was repeated, except that the mixed alkylene oxides constituted 64 percent by weight of the total of fatty alcohol and mixed alkylene oxides provided to the charge. There was thus obtained a nonionic surfactant having a hydroxyl number of 91 to 92, a Draves sink time of 43.3 seconds, a surface tension of 31.1 dynes per centimeter, a pour point of −5° C, and a solubility in the isoparaffinic solvent mentioned above of greater than 15 percent by weight at room temperature, the composition remaining unclouded after storage overnight in a refrigerator maintained at approximately 0° C. The HLB value was 4.9.

Such material was also mixed with isoparaffinic solvent of the kind indicated above at a rate of 15 percent by weight and used as a spotting agent, with satisfactory results.

EXAMPLE 3

Example 1 was repeated, except that the fatty alcohol used was a commercially available fatty alcohol characterized as containing $C_{12}$ to $C_{15}$ alkanols, and the weight percentage of mixed alkylene oxides in the charge was 64%. There was obtained a material having a hydroxyl number of 97 and a cloud point in 1% aqueous solution of 28° C and a pH of 6.63. The HLB value was 5.5. Such material was miscible at a rate of 10 percent by weight with the above-indicated isoparaffinic solvent to form a spotting-agent composition. Such composition is used for the spotting of garments to be laundered, satisfactorily.

EXAMPLE 4

Example 3 was repeated, except that the mixed alkylene oxides comprise 60 percent by weight of the charge and the ethylene oxide comprises 66⅔ percent by weight of the mixed oxides. This yields a nonionic surfactant having a hydroxyl number of 109, a Draves sink time of 45.4 seconds, and a surface tension of 31.2 dynes per centimeter. Such nonionic surfactant material is soluble in the above-indicated isoparaffinic solvent to the extent of greater than 10 percent by weight. The HLB value was 4.9. A composition containing 10 percent by weight of such nonionic surfactant, dissolved in such isoparaffinic solvent, is used, with satisfactory results, in the laundering of garments.

EXAMPLE 5

Example 3 was repeated, except that the fatty-alcohol fraction was one containing principally $C_{10}$ to $C_{12}$ alkanols. Again, 60 percent by weight of the alkylene oxides used was ethylene oxide, and the mixed oxides constituted 64 percent by weight of the fatty alcohol plus mixed oxides charged to the autoclave. There was obtained a material having a hydroxyl number of 128, a Draves sink time of 4.7 seconds, a surface tension of 29.0 dynes per centimeter, a pour point of −28° C, and a cloud point in 1 weight percent aqueous solution of 26° C. The HLB value was 6.2. Such material was readily soluble to the extent of 15 percent by weight or greater in the isoparaffinic solvent mentioned above. Such material is used with satisfactory results as a spotting agent in the laundering of garments.

Comparison Test A

Example 1 was repeated, except that the fatty-alcohol used is a commercially available mixture of $C_{16}$ to $C_{18}$ alkanols, and the weight percentage of mixed alkylene oxides used in the charge is 60%. There was obtained a material having a hydroxyl number of 84.3, a Draves sink time of 112 seconds, a surface tension of 34.4 dynes per centimeter, and a cloud point of less than 0° C. The HLB value was 4.2. The solubility of this material in the isoparaffinic solvent mentioned above is poor.

Comparison Test B

Example 2 was repeated, except that ethylene oxide was present in the mixed oxides to an extent of 75%. The material obtained had a Draves sink time of 15 seconds and a surface tension of 29.4 dynes per centimeter in 0.1 weight percent aqueous solution, and a neat pour point of 5° C. The HLB value was 5.2. When mixed with the above-mentioned isoparaffinic solvent at the rate of 5 weight percent, such nonionic surfactant immediately created a hazy solution. Such material was obviously unsuitable and was not tested further.

Comparison Test C

Example 1 was repeated, except that the mixed ethylene oxide and propylene oxide amounted to 50 percent of the charge, instead of 57.6%. A nonionic surfactant having a hydroxyl number of 126, a Draves sink time of 147 seconds, a surface tension of 31.3 dynes per centimeter, a pour point of 2.5° C, and a cloud point in 0.1 weight percent solution of less than 0° C was obtained. The HLB value was 4.1. Although this material was soluble to an extent greater than 15 weight percent in the above-indicated isoparaffinic solvent, the relatively high Draves sink time and relatively low cloud point indicate that it would not have satisfactory performance as a spotting agent, being poor in detergency, and such agent has not been further tested.

Comparison Test D

Comparison Test C was repeated, except that the charge of fatty alcohol plus mixed alkylene oxides contained 75 percent by weight of mixed alkylene oxides. There was obtained a material having a hydroxyl number of 64, a Draves sink time of 24.7 seconds, a surface tension of 34.7 dynes per centimeter, a pour point of −12° C and a cloud point, in a solution of the concentration indicated above, of 52° C. The HLB value was 5.6. Despite the desirably high cloud point and desirably low Draves sink value, such material was not suitable for incorporation with the isoparaffinic solvent mentioned above, because the addition of 5 percent by weight of such material to such isoparaffinic solvent gave a hazy material, and after refrigeration overnight, separation occurred. This material was not tested further.

From the foregoing examples and comparison tests, it is evident that any composition which is too rich in $C_{17}$ or $C_{18}$ alkanols, more than about 20 percent by weight, will yield unsatisfactory results because of poor solubility in the isoparaffinic solvent and relatively poor detergency (high Draves sink time and low cloud point, as shown in Comparison Test A); that even with the use of a satisfactory fatty-alcohol component, such as "Blend A", poor solubility in the isoparaffinic solvent is obtained when the percentage by weight of ethylene oxide in the mixed oxides equals 75% (see Comparison Test B); that when "Blend A" is used and the percentage of mixed oxides in the charge of mixed oxides plus fatty alcohol is as low as 50%, the detergency of the spotting-agent composition which results is poorer (see the relatively high Draves sink time and low cloud point in Comparison Test C, and see also the relatively marginal performance of the composition of Example 1); and that with "Blend A", but with 75 percent of weight of mixed oxides in the charge, there is obtained a material which has inadequate solubility in the isoparaffinic solvent (see Comparison Test D).

Accordingly, it can be stated that in one aspect, the present invention concerns a spotting-agent composition for use in laundering garments which consists essentially of a solution of (1) about 10 weight percent or more of a nonionic surfactant produced by reacting a mixture of fatty alcohols containing 10 to 18 carbon atoms (with the proviso that the proportion of such alcohols which is attributable to alcohols containing 17 or more carbon atoms is limited to about 20 percent by weight) with mixed lower-alkylene oxides (ethyene oxide and propylene oxide) to such an extent as to have the mixed oxides comprise about 57 to 68 weight percent of the total fatty alcohol plus alkylene oxides used, with the proportion of ethylene oxide in the mixed oxides used being about 50 to 70%, in (2) an isoparaffinic solvent made in a mixture of isoparaffins containing an average of about 11 to 14, preferably 12 to 13, carbon atoms. In another aspect, the present invention comprises the use of a composition as defined above as a spotting agent; that is, the agent is applied to a spot of organic soil on the garment, before the garment is laundered.

The present invention affords an improvement in the art of spotting and laundering garments in one or more of several different respects. First, the detergency of the composition mentioned above as constituting the closest known prior art was relatively poor, as indicated by a cloud point of less than 0° C, and several of the materials indicated have cloud points considerably higher than that. Second, those skilled in the art know that the fatty-alcohol ingredient is relatively more expensive than the alkylene oxides, and the composition indicated above as constituting the closest prior art uses about 53 weight percent of fatty alcohols and only about 47 percent by weight of alkylene oxides, whereas the compositions according to the present invention contain about 57 to 68 weight percent of alkylene oxide. Third, it has not been obvious to those of ordinary skill in the art how a material of good detergency and satisfactory compatibility with the isoparaffinic solvent could be obtained, or even that such a composition, superior to the composition indicated above as being the closest prior art, could be produced at all.

Obviously obtaining satisfactory results is not merely a matter of producing a nonionic surfactant having a proper HLB value. The invention disclosed is unobvious to anyone who has not actually worked with the problem.

While we have shown and described herein certain embodiments of our invention, we intend to cover as well any change or modification therein which may be made without departing from its spirit and scope.

The embodiments of the invention in which an exclusive property or privilege is claimed are defined as follows:

1. A method of spotting and laundering a garment containing organic soil in an area of said garment, said method comprising applying to said garment in the vicinity of said organic soil a composition which consists essentially of a solution of (1) about 10 weight percent or more of nonionic surfactant produced by reacting a mixture of fatty alcohols containing 10 to 18 carbon atoms (with the proviso that the proportions of such alcohols which is attributable to alcohols containing 17 or more carbon atoms is limited to about 20 percent by weight) with mixed lower-alkylene oxides selected from the group consisting of ethylene oxide and propylene oxide to such an extent as to have the mixed oxides comprise about 57 to 68 weight percent of the total fatty alcohols plus alkylene oxides used, with the proportion of ethylene oxide in the mixed oxides used being about 50 to 70 percent, and (2) an isoparaffinic solvent made of a mixture of isoparaffins containing an average of about 11 to 14 carbon atoms, and then laundering said garment.

2. A method as defined in claim 1, wherein the said mixture of fatty alcohols containing 10 to 18 carbon atoms consists essentially of a mixture of fatty alcohols containing approximately 10 percent $C_{12}$ alkanols, 15 percent $C_{13}$ alkanols, 35 percent $C_{14}$ alkanols, 10 percent $C_{15}$ alkanols, 20 percent $C_{16}$ alkanols and 10 percent $C_{18}$ alkanols.

3. A method as defined in claim 1 wherein said mixture of fatty alcoholscontaining 10 to 18 carbon atoms consists of a fatty-alcohol fraction containing alkanols containing 12 to 15 carbon atoms.

4. A method as defined in claim 1 characterized in that said mixture of fatty alcohols containing 10 to 18 carbon atoms consists essentially of a mixture of alcohols containing 10 to 12 carbon atoms.

* * * * *